US009443503B2

(12) United States Patent
Sugiyama

(10) Patent No.: US 9,443,503 B2
(45) Date of Patent: Sep. 13, 2016

(54) SIGNAL PROCESSING DEVICE, SIGNAL PROCESSING METHOD AND SIGNAL PROCESSING PROGRAM

(75) Inventor: Akihiko Sugiyama, Tokyo (JP)

(73) Assignee: NEC CORPORATION, Tokyo (JP)

( * ) Notice: Subject to any disclaimer, the term of this patent is extended or adjusted under 35 U.S.C. 154(b) by 203 days.

(21) Appl. No.: 13/883,618

(22) PCT Filed: Nov. 22, 2011

(86) PCT No.: PCT/JP2011/077442

§ 371 (c)(1),
(2), (4) Date: May 6, 2013

(87) PCT Pub. No.: WO2012/070684

PCT Pub. Date: May 31, 2012

(65) Prior Publication Data

US 2013/0223639 A1 Aug. 29, 2013

(30) Foreign Application Priority Data

Nov. 25, 2010 (JP) ..... 2010-263021

(51) Int. Cl.
*G10K 11/16* (2006.01)
*H04R 3/04* (2006.01)
(Continued)

(52) U.S. Cl.
CPC ..... *G10K 11/16* (2013.01); *G10L 21/034* (2013.01); *H04R 3/04* (2013.01); *G10L 21/0208* (2013.01); *H04R 2410/00* (2013.01); *H04R 2499/11* (2013.01)

(58) Field of Classification Search
CPC . G10L 19/012; G10L 21/0208; G10L 21/02; G10L 3/02; G10L 3/00; G10L 15/20; G10L 15/22; G10L 15/065; G10L 21/0272; G10L 25/84; G10L 25/78; G10L 25/93; G10L 2021/02087; G10L 2025/783; G10L 21/0316; G10L 19/0204; H04B 15/00; H04J 11/00; H01H 33/59; G06F 3/165; G06F 3/167; G06F 3/16; G06F 17/3074; G06F 17/30746; G06F 1/00; H03G 3/20; H03G 3/00; H03G 3/302632; H03G 1/04; H03G 5/165; H03G 9/025; H04R 3/002; H04R 3/04; H04R 3/00; H04R 2227/005; H04R 2410/05; H04R 19/016; H04R 1/1083; H04R 2420/01; H04R 2430/01; H04R 25/353; G11B 20/10527; G11B 2020/10592; G11B 27/11; H03F 2200/03; H03F 1/0222; H03F 1/025; H04M 3/568; H04M 9/082; H04N 5/04; H04N 9/7904; H04N 21/23
USPC ..... 381/94.1–94.7, 94.9, 97, 98, 99, 100, 381/71.1, 71.9, 71.11, 71.12, 71.13, 4, 83, 381/120, 121, 101, 102, 103, 104, 105, 106, 381/107, 108, 110; 704/226–228, 233, 214; 342/383; 370/203; 379/392.01; 455/570, 114.2, 135, 222, 223, 283; 700/94
See application file for complete search history.

(56) References Cited

U.S. PATENT DOCUMENTS

| | | | | |
|---|---|---|---|---|
| 6,044,341 | A | 3/2000 | Takahashi | |
| 2007/0257840 | A1* | 11/2007 | Wang et al. | 342/383 |
| 2010/0036659 | A1* | 2/2010 | Haulick et al. | 704/226 |

FOREIGN PATENT DOCUMENTS

| | | | |
|---|---|---|---|
| EP | 2151821 | B1 | 12/2011 |
| JP | 6-67691 | A | 3/1994 |

(Continued)

OTHER PUBLICATIONS

Extended European Search Report dated Apr. 1, 2014, issued by the European Patent Office in corresponding European Application No. 11842999.2.

(Continued)

*Primary Examiner* — Leshui Zhang
(74) *Attorney, Agent, or Firm* — Sughrue Mion, PLLC

(57) ABSTRACT

The present invention compensates output variability caused by the difference in the performance of and the individual difference between converter devices when processing the signals inputted by means of a converter device, and performs highly-accurate signal processing.
The present invention is provided with an input means which inputs an input signal through a converter device, a memory means which stores a minimum value of a reference signal inputted through a reference converter device, a comparison means which compares a minimum value of the input signal and the minimum value of the reference signal, and a modification means which modifies the input signal in accordance with the comparison result of the comparison means.

13 Claims, 9 Drawing Sheets

(51) Int. Cl.
*G10L 21/034* (2013.01)
*G10L 21/0208* (2013.01)

(56) References Cited

FOREIGN PATENT DOCUMENTS

| | | | |
|---|---|---|---|
| JP | 8-221092 | A | 8/1996 |
| JP | 11-38998 | A | 2/1999 |
| JP | 2003527012 | A | 9/2003 |
| JP | 2005130328 | A | 5/2005 |
| JP | 2006262241 | A | 9/2006 |
| JP | 2006-279185 | A | 10/2006 |
| JP | 2006287387 | A | 10/2006 |
| JP | 2008-216721 | A | 9/2008 |
| JP | 2008-256433 | A | 10/2008 |
| JP | 4282227 | B2 | 6/2009 |
| JP | 2009-535998 | A | 10/2009 |
| JP | 201122604 | A | 2/2011 |

OTHER PUBLICATIONS

International Search Report for PCT/JP2011/077442 dated Feb. 7, 2012.
Communication dated Nov. 4, 2015, from the Japanese Patent Office in counterpart application No. 2012-545822.
Communication dated Jun. 7, 2016 from the Japanese Patent Office in counterpart application No. 2012-545822.

* cited by examiner

SIGNAL PROCESSING DEVICE, SIGNAL PROCESSING METHOD AND SIGNAL PROCESSING PROGRAM

CROSS REFERENCE TO RELATED APPLICATIONS

This application is a National Stage of International Application No. PCT/JP2011/077442 filed Nov. 22, 2011, claiming priority based on Japanese Patent Application No. 2010-263021 filed Nov. 25, 2010, the contents of all of which are incorporated herein by reference in their entirety.

TECHNICAL FIELD

The present invention relates to a signal processing technology which processes a signal and obtains a target output.

BACKGROUND ART

A signal processing technology for processing an input signal using a converter device and obtaining a target output is known. For example, a noise suppressing technology exists. It suppresses noise in a noisy signal and outputs an enhanced signal. Here, the noisy signal is a signal in which noise is superposed on the target signal. The enhanced signal is a signal in which the target signal is emphasized. A noise suppressor which suppresses noise superposed on a target speech signal is used for various audio terminals such as a cellular phone or like.

As this kind of technological example, patent document 1 discloses a method to suppress noise by multiplying the suppression coefficient smaller than 1 to an input signal. Patent document 2 discloses a method to suppress noise by subtracting presumed noise directly from a noisy signal. Patent document 3 discloses a noise suppression system which can realize the sufficient noise suppression effect and the small distortion in the enhanced signal, even when a condition that noise is sufficiently small compared to a target signal is not satisfied. Patent document 3 assumes a case when the characteristics of noise mixed in the target signal is known to some extent beforehand. The technology described in patent document 3 suppresses noise by subtracting noise information recorded beforehand from a noisy signal. Here, noise information is information about characteristics of noise.

PRIOR ART DOCUMENT

Patent Literature

[Patent document 1] Japanese Patent Publication No. 4282227

[Patent document 2] Japanese Patent Application Laid-Open No. 1996-221092

[Patent document 3] Japanese Patent Application Laid-Open No. 2006-279185

SUMMARY OF THE INVENTION

Problem to be Solved by the Invention

However, in the configurations disclosed by the above-mentioned patent documents 1 to 3, output variability is caused by the difference in performance of and the individual difference between converter devices occurs, and highly-accurate signal processing could not be performed.

Based on as mentioned above, the object of the present invention is to provide a signal processing technology which solves the above-mentioned problem.

Means for Solving a Problem

In order to achieve the above-mentioned object, an apparatus according to the present invention includes an input means which inputs an input signal through a converter device, a memory means which stores a minimum value of a reference signal inputted through a reference converter device, a comparison means which compares a minimum value of the input signal and the minimum value of the reference signal, and a modification means which modifies the input signal in accordance with the comparison result of the comparison means.

In order to achieve the above-mentioned object, a method according to the present invention inputs an input signal through a converter device and compares a minimum value of an inputted reference signal and a minimum value of an input signal through a reference converter device, and modifies the input signal in accordance with the comparison result.

In order to achieve the above-mentioned object, a program stored in a program recording medium according to the present invention makes a computer execute a step which inputs an input signal through a converter device, a step which compares a minimum value of a reference signal inputted through a reference converter device and a minimum value of an input signal, and a step which modifies the input signal in accordance with the comparison result.

Effect of the Invention

According to the present invention, the signal processing technology which compensates output variability caused by the difference in performance of and the individual difference between converter devices, and performs highly-accurate signal processing can be provided.

EXEMPLARY EMBODIMENTS FOR CARRYING OUT OF THE INVENTION

Exemplary embodiments of the present invention will be described in detail exemplarily with reference to drawings below. However, components which are described in the following exemplary embodiments are only illustration and they do not limit the technological scope of the present invention only thereto. Further, a "converter device" in the following description is a so-called transducer. Specifically, the "converter device" is an electric and electronic device or an electric machine which changes a certain kind of energy into another thing for various purposes including measuring and information transfer. The "converter device" includes an device or an apparatus which changes a measured value to an electric signal like a sensor and a microphone (hereinafter, mike), for example.

(First Exemplary Embodiment)

Figure 1:
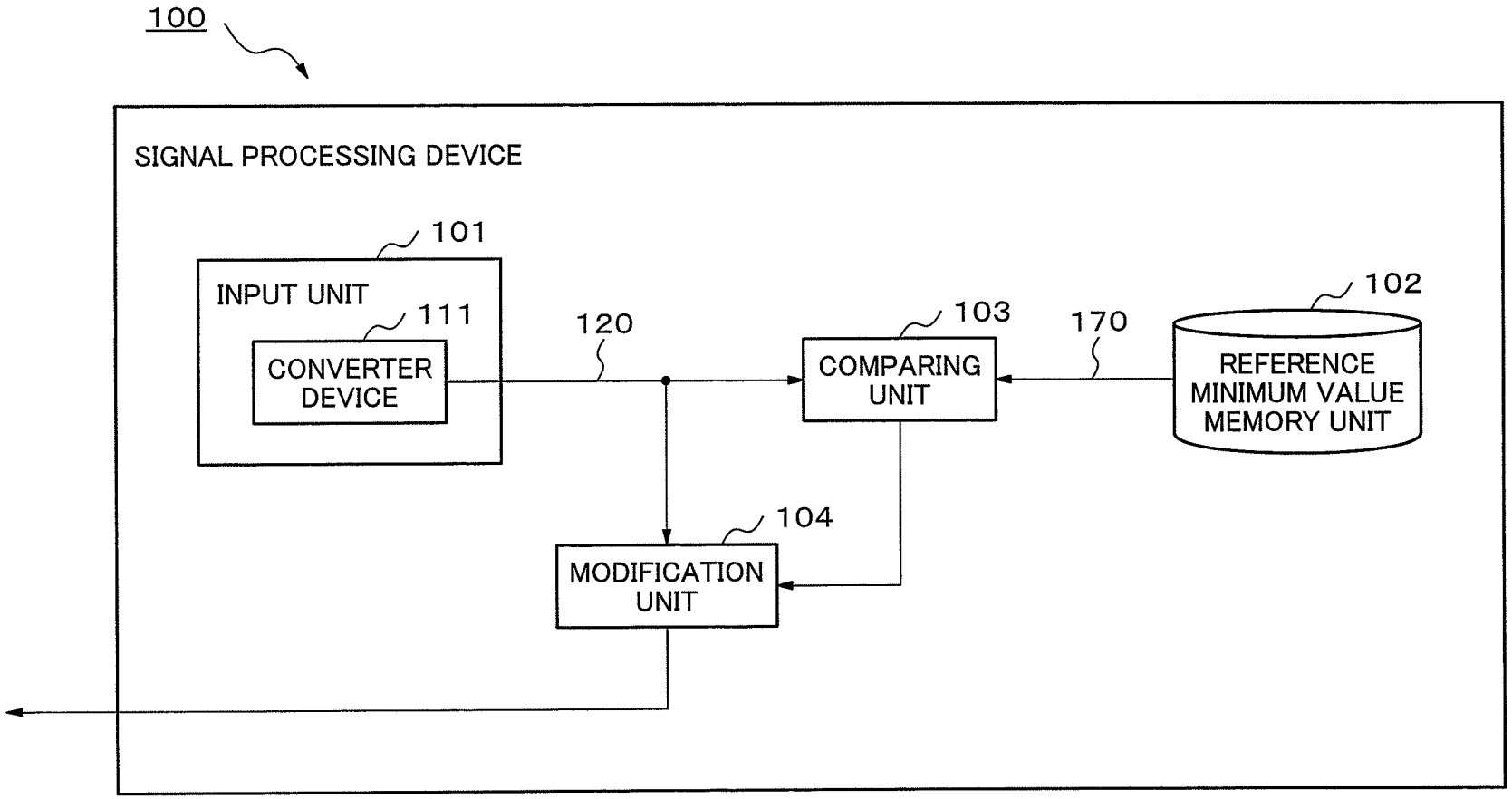
FIG. 1 It is a block diagram showing a schematic configuration of a signal processing device as a first exemplary embodiment of the present invention.

A signal processing device 100 as a first exemplary embodiment of the present invention will be described using FIG. 1.

The signal processing device 100 includes an input unit 101, a reference minimum value memory unit 102, a comparing unit 103 and a modification unit 104. The input unit 101 inputs an input signal 120 to the comparing unit 103 and the modification unit 104 through a converter device 111. The reference minimum value memory unit 102 stores a minimum value (reference minimum value) of a reference signal inputted through a reference converter device. And the comparing unit 103 compares a minimum value of the input signal 120 and the reference minimum value. The modification unit 104 modifies the input signal 120 in accordance with the comparison result of the comparing unit 103.

By the above configuration, the signal processing device 100 according to this exemplary embodiment compensates output variability caused by the difference in the performance of and the individual difference between converter devices, and can perform highly-accurate signal processing.

(Second Exemplary Embodiment)

Figure 2:
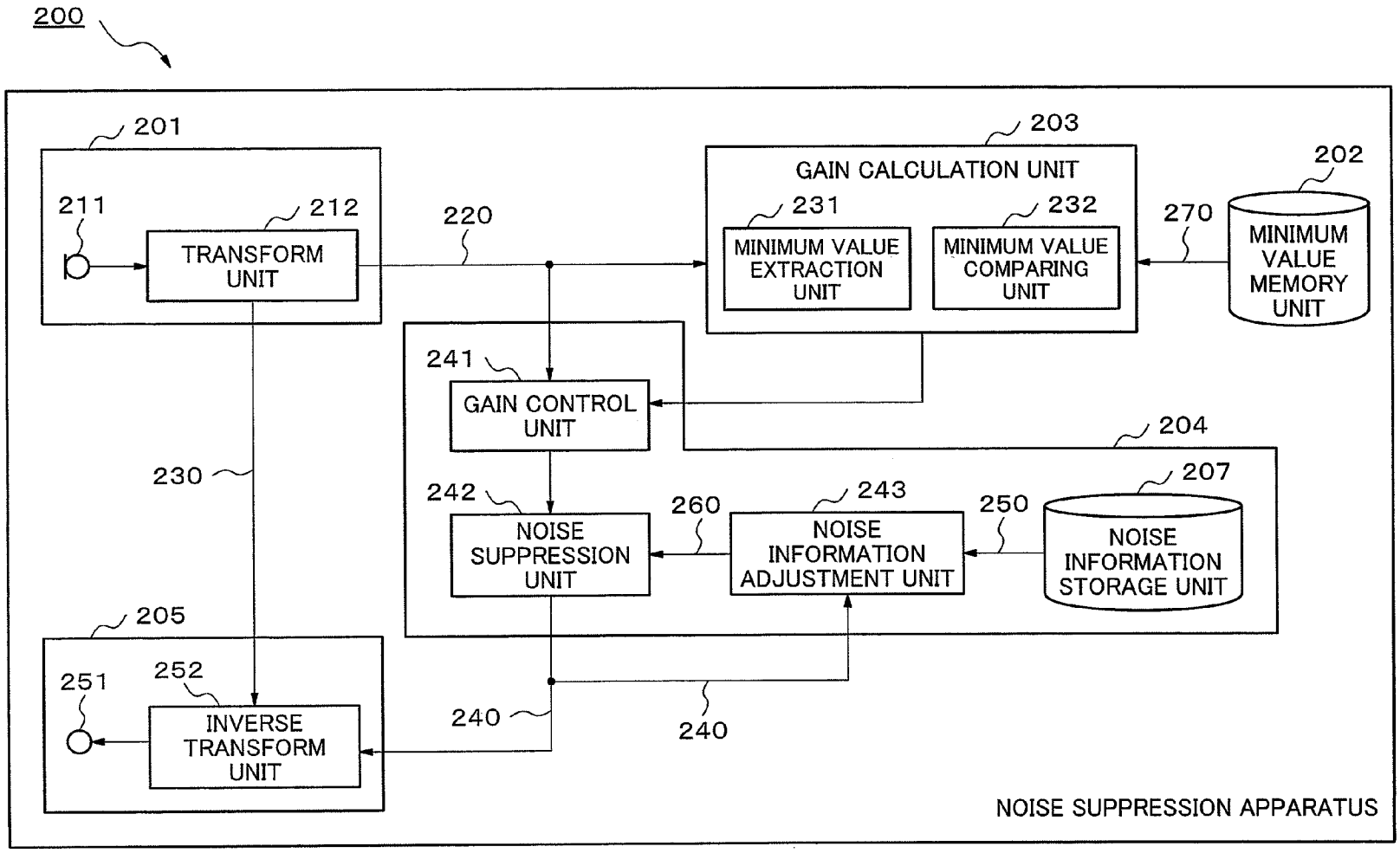
FIG. 2 It is a block diagram showing a schematic configuration of a noise suppression apparatus as a second exemplary embodiment of the present invention.

As a second exemplary embodiment that realizes a signal processing method according to the present invention, a noise suppression apparatus 200 will be described. FIG. 2 is a block diagram showing an entire configuration of the noise suppression apparatus 200. Although the noise suppression apparatus 200 also functions as the part of the apparatus such as a digital camera, a laptop computer and a cellular phone, for example, the present invention is not limited to this. The noise suppression apparatus 200 can be applied to all signal processing devices which are required the noise suppression from an input signal.

<Entire Configuration>

As shown in FIG. 2, the noise suppression apparatus 200 includes an input unit 201, a minimum value memory unit 202, a gain calculation unit 203, a modification unit 204 and an output unit 205. The input unit 201 among these includes a mike 211 as a converter device and a transform unit 212 which performs conversion processing to an output of the mike 211. The input unit 201 decomposes a noisy signal into frequency components and supplies them to the gain calculation unit 203 as a comparison means and the modification unit 204.

The mike 211 is supplied a noisy signal as a sample value sequence. Here, the noisy signal is a signal in which a target signal and noise are intermingled.

When the noisy signal is supplied to the mike 211, the transform unit 212 performs conversion such as Fourier transform to the supplied noisy signal and divides into a plurality of frequency components. The transform unit 212 supplies a amplitude spectrum 220 among a plurality of frequency components to the gain calculation unit 203 and a gain control unit 241. The transform unit 212 transmits a phase spectrum 230 among a plurality of frequency components to an inverse transform unit 252.

The gain control unit 241 receives the amplitude spectrum from the transform unit 212. The gain control unit 241 multiplies the amplitude spectrum by a gain and supplies the result to a noise suppression unit 242.

Further, here, although the transform unit 212 supplies the amplitude spectrum 220 to the noise suppression unit 242 via the gain control unit 241, the present invention is not limited to this. The transform unit 212 may supply a power spectrum which corresponds to a square of the amplitude spectrum 220 to the noise suppression unit 242 via the gain control unit 241.

The minimum value memory unit 202 includes a memory device such a semiconductor memory. The minimum value memory unit 202 stores a reference minimum value about noise. The reference minimum value may be determined by recording only noise which this apparatus tries to suppress in a quiet room with a mike. The mike is a mike which becomes the standard as an example of a reference converter device. For example, a case when the noise suppression apparatus 200 according to this exemplary embodiment is installed in a digital camera is considered. In this case, a value in which a standard mike picked up noise which is generated in the state where the digital camera in which the noise suppression apparatus 200 was installed was powered on may be available as the reference minimum value.

A speech signal for each frequency component is inputted into the noise suppression apparatus 200 from the input unit 201. Therefore, in this exemplary embodiment, it is supposed that a reference minimum value is also prepared for each frequency component. However, the exemplary embodiment of the present invention is not limited to this.

The gain calculation unit 203 includes a minimum value extraction unit 231. The minimum value extraction unit 231 extracts a minimum value of each frequency component of the speech signal outputted from the transform unit 212. And the gain calculation unit 203 includes a minimum value comparing unit 232. The minimum value comparing unit 232 compares the extracted minimum value with the reference minimum value read from the minimum value memory unit 202.

The gain calculation unit 203 calculates a gain control value (modification factor) for each frequency component which should be applied to an input signal using a ratio of the extracted minimum value and the reference minimum value. For example, the gain calculation unit 203 calculates its gain control value so that the extracted minimum value may be identical to the reference minimum value.

The minimum value extraction unit 231 analyzes the noisy signal amplitude (or power spectrum) supplied from the transform unit 212 every one sample and derives a minimum value. Or the minimum value extraction unit 231 analyzes the noisy signal amplitude (or power spectrum) every several samples and derives the minimum value.

Whenever analyzed, the minimum value extraction unit 231 updates the minimum value and extracts the minimum value in all inputted in the past. That is, the minimum value becomes smaller as the extraction becomes a long time. Specifically, the minimum value extraction unit 231 compares the first minimum value with the second minimum value, for example, and further compares with the third minimum value and updates. Therefore, the minimum value becomes smaller one after another as the sampling becomes a long time.

The minimum value extraction unit 231 may reset the minimum value for every definite time. The minimum value comes to express the minimum component in the noisy signal, so that the interval of the reset becomes long. When the noisy signal includes a target signal and noise, and the noise has a signal level lower than the target signal, a minimum value of the noisy signal will be the minimum value of the noise. The minimum value memory unit 202 stores the minimum value obtained by recording only noise in a quiet environment as a reference minimum value. Accordingly, the gain calculation unit 203 can compare the minimum value of the same noise and get master data of gain control.

The gain control unit 241 controls a gain based on a gain calculated in the gain calculation unit 203. The timing of gain control may be every one sample and may be also every fixed number of samples. Further, the noise suppression apparatus 200 may adjust by using the same gain to all frequencies. In other words, the transform unit 212 may perform gain adjustment with the minimum value before performing the Fourier transform in the transform unit 212.

A noise information storage unit 207 includes a memory device such a semiconductor memory. The noise information storage unit 207 stores noise information (information about characteristics of noise). For example, a shape of a spectrum of noise may be available as the noise information. The frequency characteristic of the phase and the feature quantity of the strength and time change in the specific frequency may be also available as the noise information in addition to the shape of the spectrum. Additionally, statistics value (maximum, minimum, dispersion and median) or the like may be also available as the noise information.

When a spectrum is expressed in frequency components of 1024, the noise information storage unit 207 stores amplitude (or power) data of 1024. A noise information storage unit 207 may store data of a subband which is obtained by integrating a plurality of frequency components instead of the amplitude (or power) data of 1024. When the subband is used, the noise suppression apparatus 200 can reduce the required memory size and amount of operation.

And the minimum value memory unit 202 stores a minimum value about the respective spectra.

Noise information recorded in the noise information storage unit 207 is supplied to a noise information adjustment unit 243. The noise information adjustment unit 243 modifies the noise information by multiplying the scaling factor and supplies it to the noise suppression unit 242 as modified noise information.

The noise suppression unit 242 suppresses noise in each frequency using the noisy signal amplitude spectrum supplied from the gain control unit 241 and the modified noise information 260 supplied from the noise information adjustment unit 243. The noise suppression unit 242 transmits an enhanced signal amplitude spectrum 240 as the noise suppression result to an inverse transform unit 252.

Simultaneously, the noise suppression unit 242 transmits the enhanced signal amplitude spectrum 240 to the noise information adjustment unit 243.

The noise information adjustment unit 243 modifies the noise information based on the enhanced signal amplitude spectrum 240 as the noise suppression result.

The inverse transform unit 252 puts the enhanced signal amplitude spectrum 240 supplied from the noise suppression unit 242 and the phase spectrum 230 of the noisy signal supplied from the transform unit 212 together, and performs inverse transform thereto and supplies it to an output terminal 251 as an enhanced signal sample.

<Configuration of Transform Unit 212>

Figure 3:
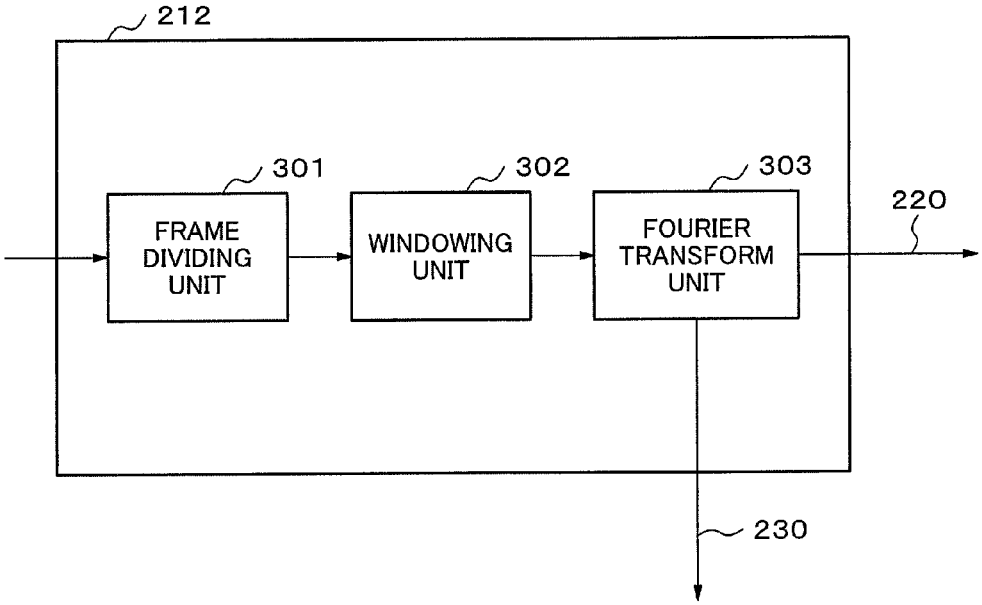
FIG. 3 It is a block diagram showing a configuration of a transform unit included in the noise suppression apparatus as the second exemplary embodiment of the present invention.

FIG. 3 is a block diagram showing an internal configuration of the transform unit 212. As shown in FIG. 3, the transform unit 212 includes a frame dividing unit 301, a windowing unit 302 and a Fourier transform unit 303. The noisy signal samples are supplied to the frame dividing unit 301 and are divided into a frame for each K/2 sample. Here, it is supposed that K is an even number. Noisy signal samples divided into frames are supplied to the windowing unit 302, and are multiplied by w(t). Here, w(t) is a window function. A signal windowed by w (t) to an input signal yn(t) (t=0 and 1, . . . , K/2−1) of the nth frame is given by following equation (1).

[Equation 1]

$$\bar{y}_n(t)=w(t)y_n(t) \tag{1}$$

The windowing unit 302 may overlap a part of two successive frames and may perform windowing. Assuming that the overlap length is 50% of the frame length, the left-hand side obtained by the following equation (2) will be the output of the windowing unit 302 for t=0, 1, . . . , K/2−1.

[Equation 2]

$$\left.\begin{aligned}\bar{y}_n(t) &= w(t)y_{n-1}(t+K/2)\\ \bar{y}_n(t+K/2) &= w(t+K/2)y_n(t)\end{aligned}\right\} \tag{2}$$

The windowing unit 22 may use a symmetrical window function to a real number signal. A window function is designed so that an input signal should be identical to an output signal except for computation error when setting a suppression coefficient in MMSE STSA method to 1, or when subtracting zero in the SS method. This means that w (t)+w(t+K/2)=1.

Hereinafter, description will be continued taking a case in which windowing is performed by overlapping 50% of two successive frames as an example. As w (t), the windowing unit 22 may use a Hanning window indicated by the following equation (3), for example.

[Equation 3]

$$w(t)=\begin{cases}0.5+0.5\cos\left(\dfrac{\pi(t-K/2)}{K/2}\right), & 0\le t<K\\ 0, & \text{otherwise}\end{cases} \tag{3}$$

Moreover, various window functions such as Hamming window, Kaiser window and Blackman window are also known. The output of windowing is supplied to the Fourier transform unit 303 and is transformed into a noisy signal spectrum Yn(k). The noisy signal spectral Yn(k) is separated into a phase and a amplitude, the noisy signal phase spectrum arg Yn(k) is supplied to the inverse transform unit 252, and the noisy signal amplitude spectrum |Yn(k)| is supplied to the gain calculation unit 203 and the gain control unit 241. As has been already described, a power spectrum may be used instead of a amplitude spectrum.

<Configuration of Inverse Transform Unit 252>

Figure 4:
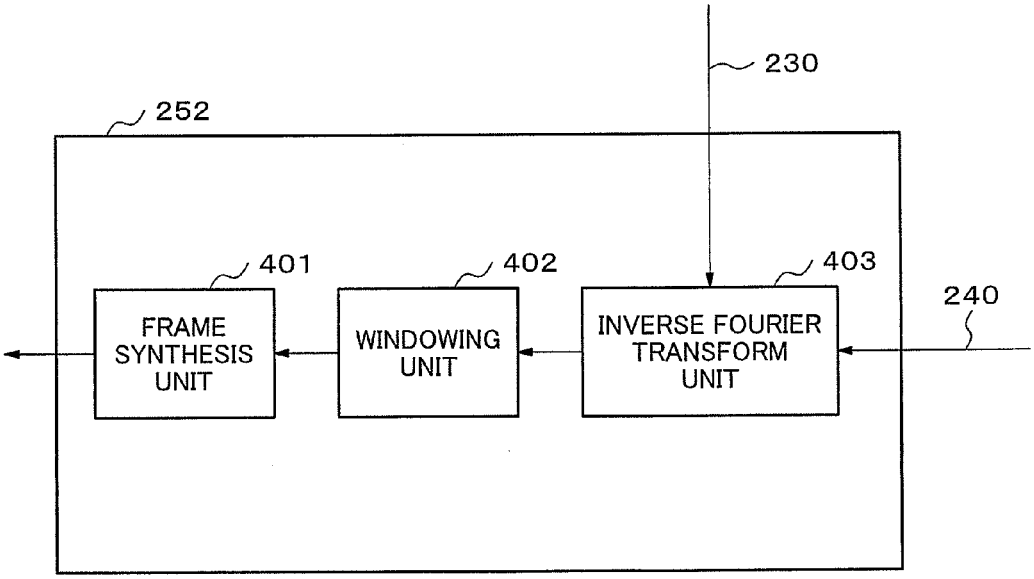
FIG. 4 It is a block diagram showing a configuration of an inverse transform unit included in the noise suppression apparatus as the second exemplary embodiment of the present invention.

FIG. 4 is a block diagram showing a configuration of the inverse transform unit 252. As shown in FIG. 4, the inverse transform unit 252 includes an inverse Fourier transform unit 403, a windowing unit 402 and a frame synthesis unit 401. The inverse Fourier transform unit 403 multiplies the enhanced signal amplitude spectrum 240 supplied from the noise suppression unit 242 by the noisy signal phase spectrum 230 supplied from the transform unit 212, and obtains an enhanced signal (the left-side of the following equation (4)).

[Equation 4]

$$\bar{X}_n(k)=|\bar{X}_n(k)|\cdot\arg Y_n(k) \tag{4}$$

The inverse Fourier transform unit 403 performs inverse Fourier transform of the obtained enhanced signal. The inverse Fourier transformed enhanced signal is supplied to the windowing unit 402 as a time domain sample value sequence $x_n(t)$ (t=0, 1, . . . , K−1) in which one frame includes K samples, and is multiplied by window function w(t). The signal made by windowing the input signal $x_n(t)$ (t=0, . . . , K/2−1) of the nth frame is given by the left-side of the following equation (5).

[Equation 5]

$$\bar{x}_n(t)=w(t)x_n(t) \tag{5}$$

The windowing unit 402 may perform windowing by overlapping a part of two successive frames. Assuming that 50% of the frame length is the overlap length, the left-side of the following equation will be the output of the windowing unit 402 for t=0, 1, . . . , K/2−1, and is transmitted to the frame synthesis unit 401.

[Equation 6]

$$\left.\begin{aligned}\bar{x}_n(t) &= w(t)x_{n-1}(t+K/2)\\ \bar{x}_n(t+K/2) &= w(t+K/2)x_n(t)\end{aligned}\right\} \tag{6}$$

The frame synthesis unit 401 overlaps output of two neighboring frames from the windowing unit 402 in a manner taking out K/2 samples from each of them, and obtains an output signal (the left-side of equation (7)) at t=0, 1, . . . , K−1 by the following equation (7). The obtained output signal is transmitted from the frame synthesis unit 401 to the output terminal 251.

[Equation 7]

$$\hat{x}_n(t)=(t+K/2)+\bar{x}_n(t) \tag{7}$$

Additionally, the transforms in the transformation unit 212 and the inverse transform unit 252 have been described as a Fourier transform in FIG. 3 and FIG. 4. The transform unit 212 and the inverse transform unit 252 can use another transform such as cosine transform, modified cosine transform, Hadamard transform, Haar transform or wavelet transform in place of Fourier transform.

For example, cosine transform and modified cosine transform obtain only the amplitude as a transform result. Therefore, a route to the inverse transform unit 252 from the transform unit 212 in FIG. 1 becomes unnecessary. In addition, because noise information to be recorded in the noise information storage unit 207 is only for the amplitude (or power), it contributes to a reduction in memory capacity and a reduction in amount of calculation in the noise suppression processing.

When the transform unit 212 and the inverse transform unit 252 use Haar transform, multiplication becomes unnecessary. As a result, the area when the function is integrated into an LSI can be reduced.

When the transform unit 212 and the inverse transform unit 252 use wavelet transform, the time resolution can be changed to something different by a frequency. Therefore, improvement of a noise suppression effect can be expected.

Further, the noise suppression unit 242 can perform actual suppression after a plurality of frequency components obtained in the transform unit 212 has been integrated. On this occasion, by integrating more frequency components from low frequency ranges where auditory discrimination capability is higher to high frequency ranges where auditory discrimination capability is lower, high sound quality can be achieved. Thus, when noise suppression is carried out after a plurality of frequency components have been integrated, the number of frequency components in which noise suppression is applied becomes small. Thereby, the total amount of calculation can be reduced.

<Processing of Noise Suppression Unit 242>

The noise suppression unit 242 can perform various suppressions. There are SS (Spectral Subtraction) method and MMSE STSA (Minimum Mean-Square Error Short-Time Spectral Amplitude Estimator) method as typical suppression methods.

When the noise suppression unit 242 uses SS method, the noise suppression unit 242 subtracts the modified noise information supplied from the noise information adjustment unit 243 from a noisy signal amplitude spectrum supplied from the gain control unit 241.

When the noise suppression unit 242 uses MMSE STSA method, the noise suppression unit 242 calculates a suppression coefficient for each of a plurality of frequency components using the modified noise information supplied from the noise information adjustment unit 243 and a noisy signal amplitude spectrum supplied from the gain control unit 241. Next, the noise suppression unit 242 multiplies this suppression coefficient by the noisy signal amplitude spectrum. This suppression coefficient is determined so that the mean square power of an enhanced signal should be minimized.

The noise suppression unit 242 may apply flooring in order to avoid excessive suppression on the occasion of suppression of noise. Flooring is a method to avoid suppression beyond a maximum suppression quantity. A flooring parameter determines a maximum suppression quantity.

When the noise suppression unit 242 uses SS method, the noise suppression unit 242 imposes restriction so that a result of subtraction of modified noise information from a noisy signal amplitude spectrum shall not become smaller than the flooring parameter. Specifically, when a subtraction result is smaller than the flooring parameter value, the noise suppression unit 242 substitutes the subtraction result with the flooring parameter.

When the noise suppression unit 242 uses MMSE STSA method, the noise suppression unit 242 substitutes the suppression coefficient with the flooring parameter when the suppression coefficient obtained from the modified noise information and the noisy signal amplitude spectrum is smaller than the flooring parameter.

Details of the flooring are disclosed in a document "M. Berouti, R. Schwartz and J. Makhoul, "Enhancement of speech corrupted by acoustic noise," Proceedings of ICASSP'79, pp. 208-211, April 1979".

By introducing a flooring, the noise suppression unit 242 does not cause excessive suppression. The flooring can prevent large distortions in the enhanced signal.

The noise suppression unit 242 can set the number of frequency components of the noise information such that it is smaller than the number of frequency components of the noisy signal spectrum. In this case, a plurality of noise information will be shared by a plurality of frequency components. Compared with a case when a plurality of frequency components are integrated for both a noisy signal spectrum and noise information, because frequency resolution of the noisy signal spectrum is high, the noise suppression unit 242 can achieve high sound quality with an amount of calculation less than a case when there is no integration of the frequency components at all. Details of suppression using noise information of the number of frequency components less than the number of frequency components of a noisy signal spectrum are disclosed in Japanese Patent Application Laid-Open No. 2008-203879.

<Configuration of Noise Information Adjustment Unit 243>

Figure 5:
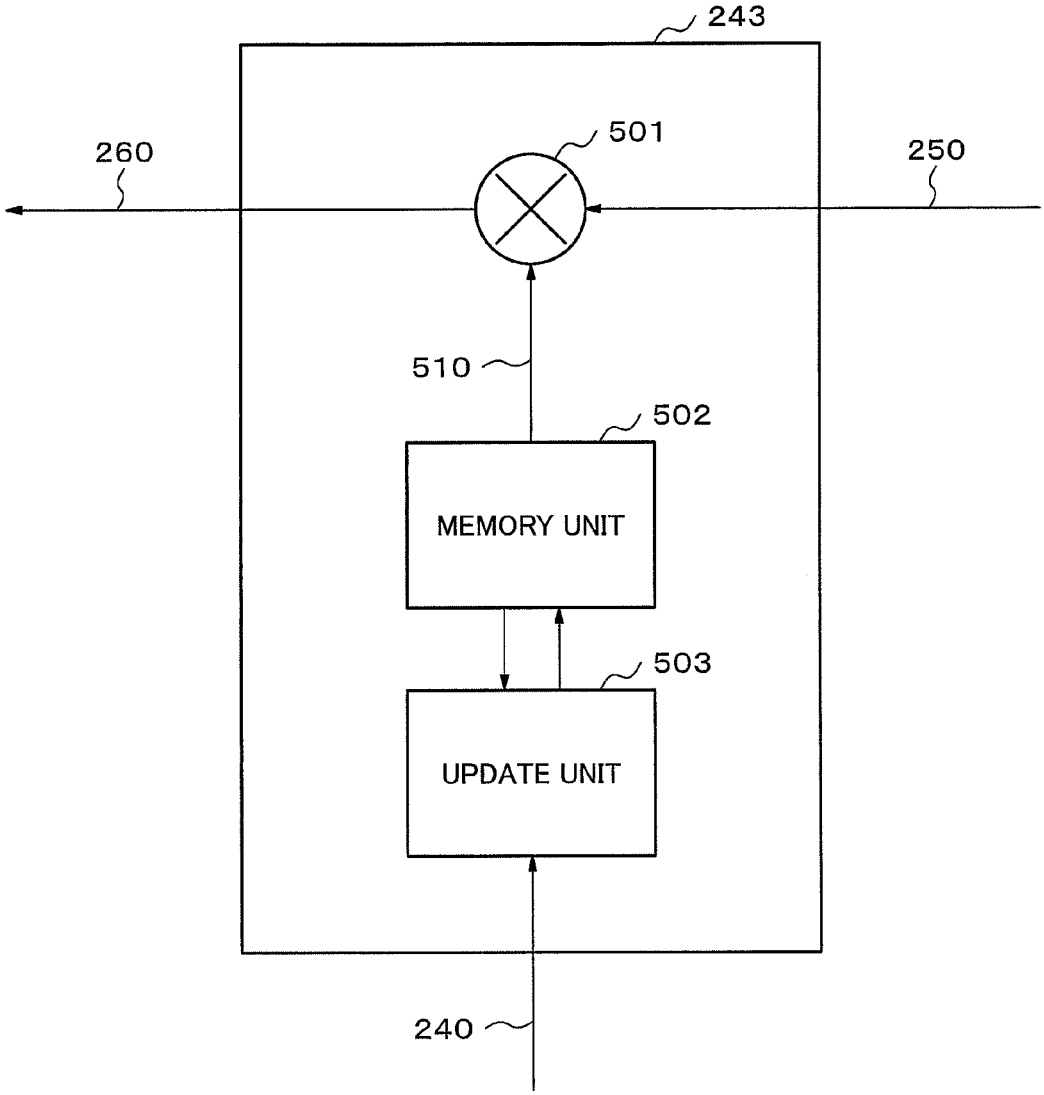
FIG. 5 It is a block diagram showing a configuration of a modification unit included in the noise suppression apparatus as the second exemplary embodiment of the present invention.

FIG. 5 is a block diagram showing a configuration of the noise information adjustment unit 243. As shown in FIG. 5, the noise information adjustment unit 243 includes a multiplication unit 501, a memory unit 502 and an update unit 503. The noise information adjustment unit 243 supplies supplied noise information 250 to the multiplication unit 501. The memory unit 502 stores a scaling factor 510 as information for modification which is used when noise information is modified. The multiplication unit 501 calculates a product of noise information 250 and the scaling factor 510, and outputs as modified noise information 260.

On the other hand, the enhanced signal amplitude spectrum 240 is supplied to the update unit 503 as a noise suppression result. The update unit 503 reads the scaling factor 510 in the memory unit 502 and changes the scaling factor 510 using the noise suppression result. The update unit 503 supplies the new scaling factor 510 after change to the memory unit 502. The memory unit 502 stores the new scaling factor 510 newly instead of the old scaling factor 510 stored until then.

Thus, the update unit 503 updates the scaling factor 510 using the noise suppression result that has been fed back to thea noise information adjustment unit 243. In this case, the update unit 503 updates the scaling factor 510 so that the larger a noise suppression result at timing without inputting a target signal is (the larger the residual noise without being suppressed is), the larger the modified noise information 260 becomes. That the noise suppression result at timing when the target signal is not inputted is large indicates that suppression is insufficient. Therefore, it is because it is desirable to make the modified noise information 260 large by changing the scaling factor 510.

When modified noise information 260 is large, because a numerical value to be subtracted will be large in SS method to become large in modal SS, a noise suppression result becomes small. Also, in multiplication type suppression like MMSE STSA method, a small suppression coefficient is obtained because an estimated signal to noise ratio used for calculation of a suppression coefficient becomes small. This brings stronger noise suppression.

As a method to update a scaling factor 510, a plurality of methods can be thought. As an example, a recalculation method and a sequential update method will be described.

As for a noise suppression result, a state that noise is suppressed completely is ideal. For this reason, when amplitude or power of a noisy signal is small, for example, the noise information adjustment unit 243 can recalculate the scaling factor or update it sequentially so that the noise may be suppressed completely. This is because, when amplitude or power of a noisy signal is small, there is a high probability that the power of signals other than the noise to be suppressed is also small. The noise information adjustment unit 243 can detect that the amplitude or power of a noisy signal is small using that the amplitude or power of the noisy signal is smaller than a threshold value.

The noise information adjustment unit 243 can also detect that the amplitude or power of a noisy signal is small by a fact that a difference between the amplitude or power of a noisy signal and noise information recorded in the noise information storage unit 207 is smaller than a threshold value. That is, when the amplitude or power of the noisy signal resembles the noise information, the noise information adjustment unit 243 utilizes that the share of the noise information in the noisy signal is high (the signal to noise ratio is low). In particular, by using information at a plurality of frequency, points in a combined manner, it becomes possible for the noise information adjustment unit 243 to compare spectral envelopes and make a highly accurate detection.

The scaling factor 510 for the SS method is recalculated so that, in each frequency, modified noise information becomes equal to a noisy signal spectrum at timing when a target signal is not inputted. In other words, the noise information adjustment unit 243 is required that a noisy signal amplitude spectrum $|Yn(k)|$ supplied from the transform unit 212 when only noise is inputted and the product of scaling factor and noise information $\nu(k)$ should be identical. Here, n is a frame index and k is a frequency index. That is, the scaling factor $\alpha n(k)$ is calculated by the following equation (8).

$$\alpha n(k)=|Yn(k)|/\nu(k) \tag{8}$$

On the other hand, in sequential update of the scaling factor 510 for the SS method, a scaling factor is updated, in each frequency, bit by bit so that an enhanced signal amplitude spectrum when a target signal is not inputted should approach zero. When the LMS (Least Squares Method) algorithm is used for sequential update, the noise information adjustment unit 243 calculates $\alpha n+1(k)$ by the following equation (9) using an error en(k) in frequency k and in frame n.

$$\alpha n+1(k)=\alpha n(k)+\mu en(k)\nu(k) \tag{9}$$

However, $\mu$ is a small constant called a step size. When immediately using the scaling factor $\alpha n(k)$ obtained by calculating, the noise information adjustment unit 243 uses the following equation (10) instead of the equation (9).

$$\alpha n(k)=\alpha n-1(k)+\mu en(k)\nu(k) \tag{10}$$

That is, the noise information adjustment unit 243 calculates the current scaling factor $\alpha n(k)$ using the current error, and apply it immediately. By updating the scaling factor 510 immediately, the noise information adjustment unit 243 can realize noise suppression with high accuracy in real time.

When the NLMS (Normalized Least Squares Method) algorithm is used, the noise information adjustment unit 243 calculates the scaling factor $\alpha n+1(k)$ by the following equation (11) using the above-mentioned error en(k).

$$\alpha n+1(k)=\alpha n(k)+\mu en(k)\nu(k)/\sigma n(k)^2 \tag{11}$$

$\sigma n(k)^2$ is the average power of the noise information $\nu n(k)$, and can be calculated using an average based on an FIR filter (a moving average using a sliding window), an average based on an IIR filter (leaky integration) or the like.

The noise information adjustment unit 243 may calculate the scaling factor $\alpha n+1(k)$ by the following equation (12) using a perturbation method.

$$\alpha n+1(k)=\alpha n(k)+\mu en(k) \tag{12}$$

The noise information adjustment unit 243 may calculate scaling factor $\alpha n+1(k)$ by the following equation (13) using a signum function $sgn\{en(k)\}$ which represents only the sign of the error.

$$\alpha n+1(k)=\alpha n(k)+\mu \cdot sgn\{en(k)\} \tag{13}$$

Similarly, the noise information adjustment unit 243 may use the LS (Least Squares) algorithm or any other adaptation algorithm. The noise information adjustment unit 243 can also apply the updated scaling factor 510 immediately, or may perform real time update of the scaling factor by referring to a change from equations (9) to (10) to modify equations (11) to (13).

The MMSE STSA method updates a scaling factor sequentially. In each frequency, the noise information adjustment unit 243 updates the scaling factor $\alpha n(k)$ using the same method as the method described using the equation (8) to equation (13).

Regarding the recalculation method and the sequential update method which are the updating methods of the scaling factor 510, the recalculation method has better tracking capability, and the sequential update method has high accuracy. In order to utilize these features, the noise information adjustment unit 243 can change an updating method such as using the sequential update method in the beginning and using the recalculation method later. In order to determine timing of changing the updating method, the noise information adjustment unit 243 may change the updating method on condition that the scaling factor became sufficiently close to the optimum value. And the noise information adjustment unit 243 may change the updating method when a predetermined time has elapsed, for example. Moreover, the noise information adjustment unit 243 may change it when a modification amount of the scaling factor has become smaller than a predetermined threshold value.

The noise suppression apparatus 200 according to this exemplary embodiment can compensate the difference in the performance of and the individual difference between mikes, and can perform highly-accurate noise suppression processing with little variation.

(Third Exemplary Embodiment)

Figure 6:
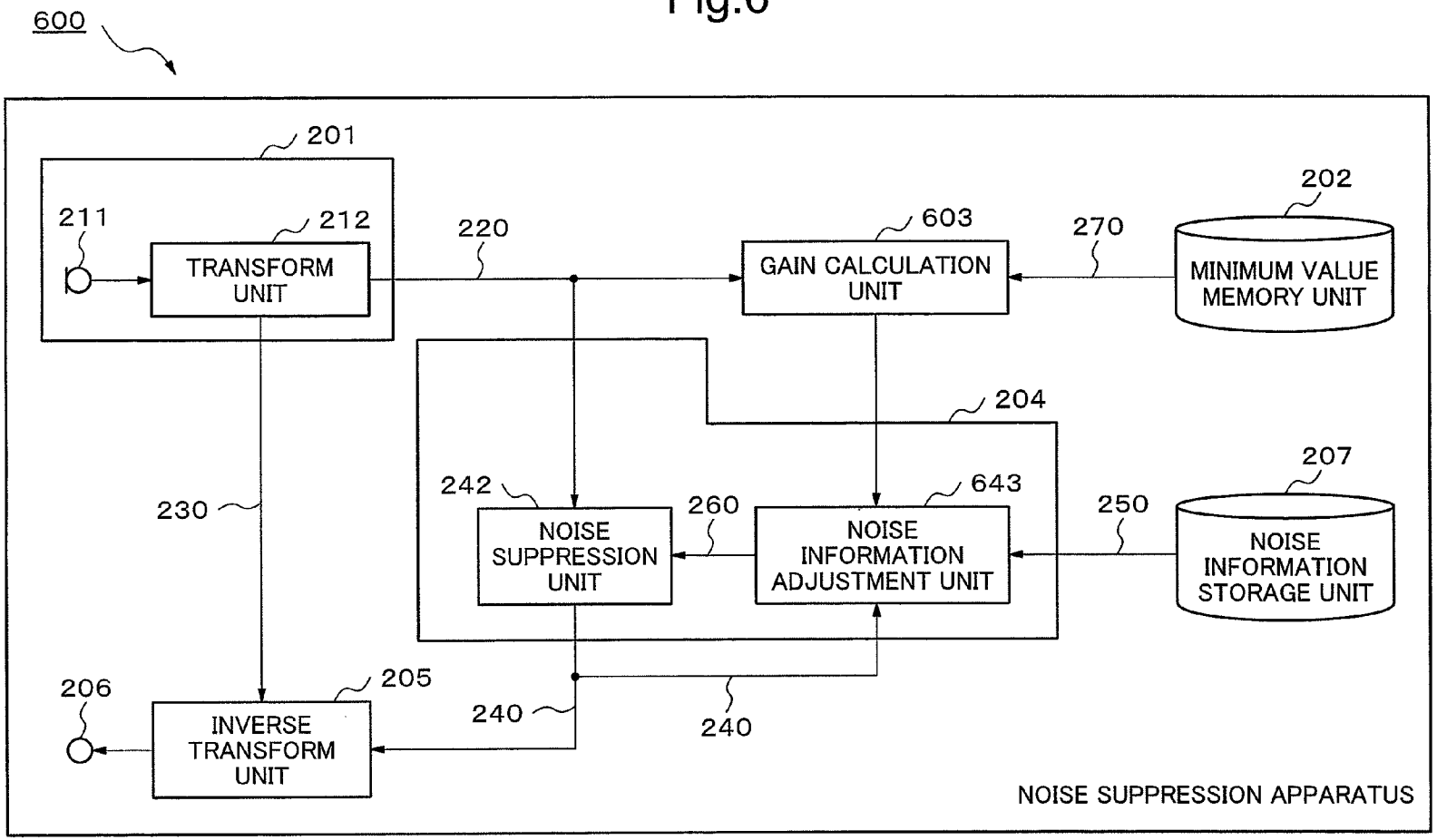
FIG. 6 It is a block diagram showing a schematic configuration of a noise suppression apparatus as a third exemplary embodiment of the present invention.

A third exemplary embodiment of the present invention will be described using FIG. 6. As shown in FIG. 6, a noise suppression apparatus 600 according to the third exemplary embodiment does not include the gain control unit 241. A gain calculation unit 603 in the noise suppression apparatus 600 as the third exemplary embodiment is different from the first exemplary embodiment mentioned above, and supplies the ratio of the calculated minimum value to a noise information adjustment unit 643.

And the noise information adjustment unit 643 adjusts noise information which should be supplied to the noise suppression unit 242 based on the ratio of the minimum value. At the same time, the noise information adjustment unit 643 inputs the output signal 240 outputted from the noise suppression unit 242, and adjusts so that the noise information 250 may be emphasized when there are remnants of noise.

Because other configuration and operation are the same as the first exemplary embodiment, the same code is attached to the same configuration and a detailed description is omitted here.

The noise suppression apparatus 600 according to this exemplary embodiment is possible to adjust noise information in accordance with the difference of the performance of and the individual difference between mikes like the first exemplary embodiment, and to suppress noise, and can perform highly-accurate noise suppression with little variation.

(Fourth Exemplary Embodiment)

Figure 7:
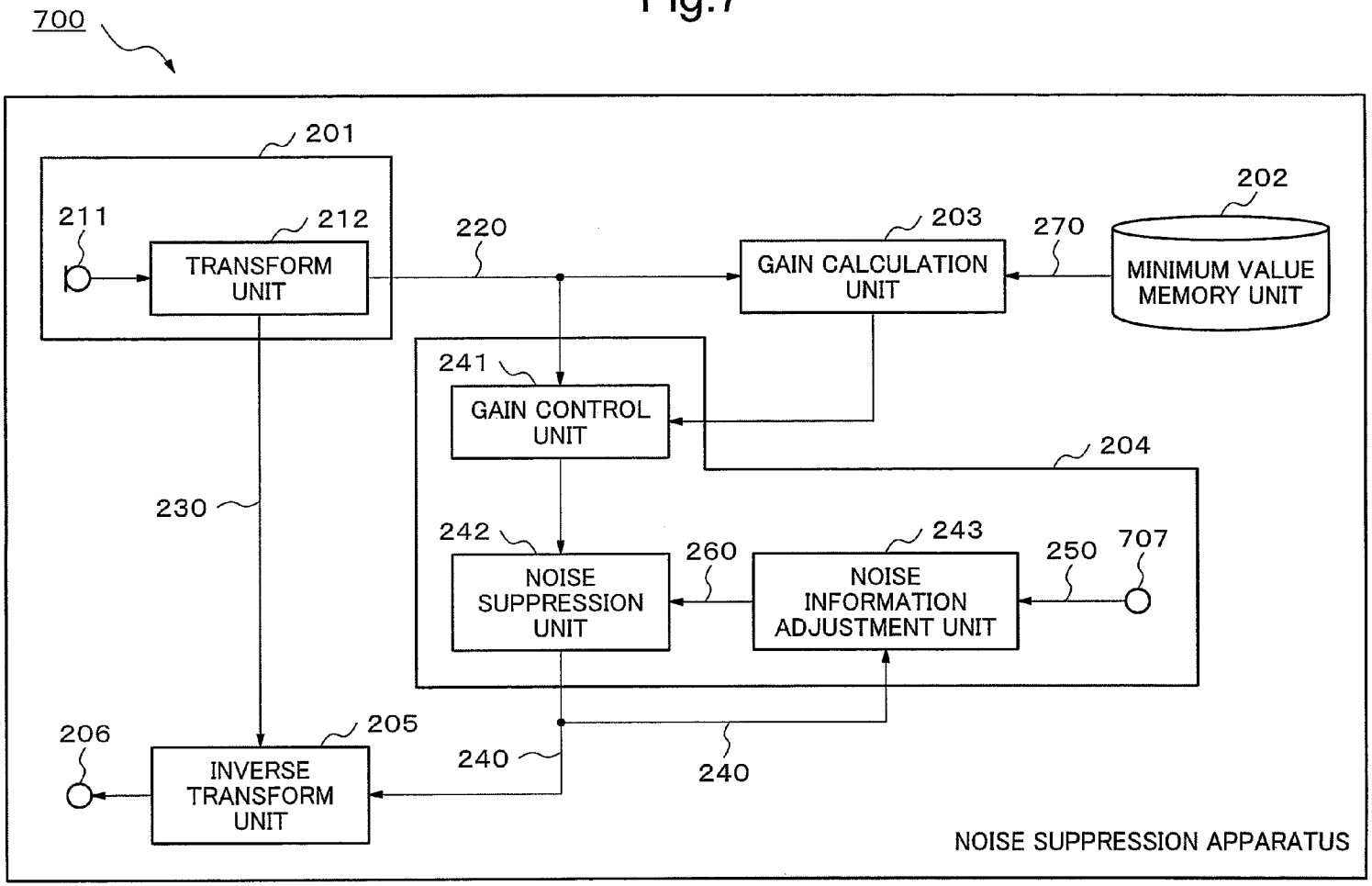
FIG. 7 It is a block diagram showing a schematic configuration of a noise suppression apparatus as a fourth exemplary embodiment of the present invention.

A fourth exemplary embodiment of the present invention will be described using FIG. 7. A noise suppression apparatus 700 as a fourth exemplary embodiment is different from the first exemplary embodiment mentioned above does not include the noise information storage unit 207, inputs a noise spectrum (noise information) in real time from a noise source via an input terminal 707 and transmits to the noise information adjustment unit 243. Because other configuration and operation are the same as the first exemplary embodiment, the detailed description will be omitted here.

For example, there is another mike near the source of noise, and a case when an output of the mike for the noise is transmitted to an input terminal 707 is considered. However, this exemplary embodiment is not limited to this, and it is applicable in every kind of case where the noise information can be obtained from outside. The noise information is modified based on a noise suppression result in the noise information adjustment unit 243 like the first exemplary embodiment, modified noise information is generated and the modified noise information is transmitted to the noise suppression unit 242 even in this case.

The noise suppression apparatus 700 according to this exemplary embodiment can obtain more accurate noise information. Because a change in noise can also be followed, the noise suppression apparatus 700 can suppress various noises including unknown noise effectively further without storing a large number of noise information in advance. In particular, because the noise information adjustment unit 243 exists, the noise suppression apparatus 700 can follow a variation in the electrical characteristic of the mike for target signals and the mike for noise.

(Fifth Exemplary Embodiment)

Figure 8:
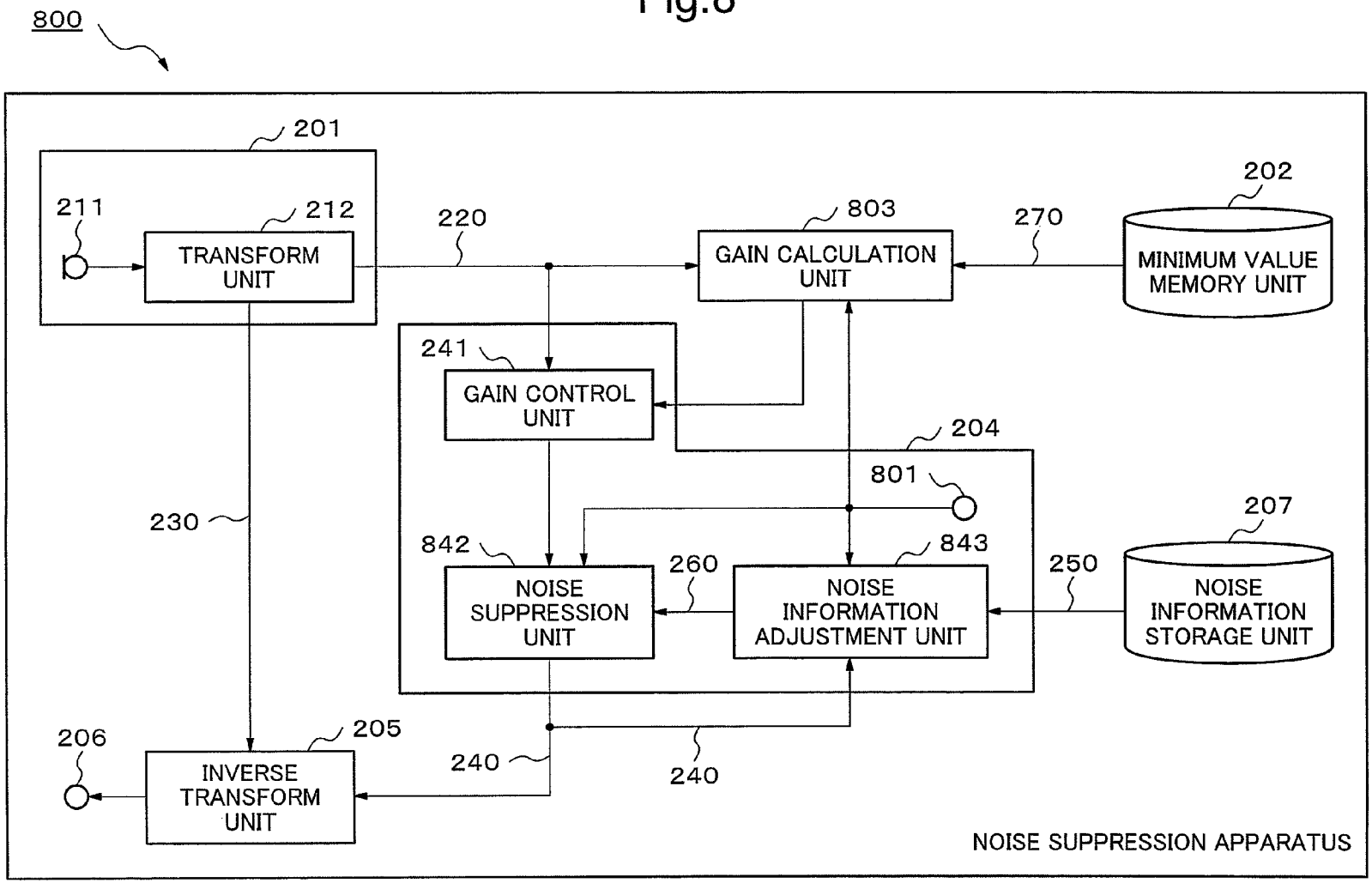
FIG. 8 It is a block diagram showing a schematic configuration of a noise suppression apparatus as a fifth exemplary embodiment of the present invention.

A fifth exemplary embodiment of the present invention will be described using FIG. 8. A gain calculation unit 803, a noise suppression unit 842 and a noise information adjustment unit 843 included in a noise suppression apparatus 800 as a fourth exemplary embodiment are supplied more information (noise existence information) which shows whether specific noise exists in the inputted noisy signal from an input terminal 801. Thereby, the noise suppression apparatus 800 can suppress the noise certainly at timing when specific noise exists and simultaneously, update information for modification. Moreover, when searching a minimum value of a noisy signal using noise existence information, a noise suppression apparatus 800 can find a minimum value of the noise certainly. Because other configuration and operation are the same as the first exemplary embodiment, the detailed description will be omitted here.

Further, when noise start information is acquired from an input terminal 801, the gain calculation unit 803 may start calculation of a minimum value from t(1) after fixed time lapse from the noise start time t(0). In the case, the gain calculation unit 803 should calculate the minimum value of the noise in the sound acquired after t(2) at timing of t(2), t(3), t(4) . . . at stated intervals. The calculated minimum value may be stored in a ring buffer (or shift memory) as Min(2), Min(3), Min(4), . . . , respectively. After that, when noise end information is acquired from an input terminal 801, the gain calculation unit 803 reads the minimum values Min(n−1) to t(n−1) at the time of going back for a definite period of time from noise end time t(n).

By doing in this way, the gain calculation unit 803 can eliminate the minimum value of the noise in an unstable operation state such as the timing at which a motor begins to move, or just before stopping. In other words, the noise of a period which does not calculate a minimum value about fixed period just after noise starting and just before noise end, and only a minimum value of the noise of the stable period can be used.

Because the noise suppression apparatus 800 according to this exemplary embodiment does not update information for modification at timing when a specific noise does not exist, accuracy of noise suppression to the specific noise can be improved in addition to the effect of the second exemplary embodiment.

(Sixth Exemplary Embodiment)

Figure 9:
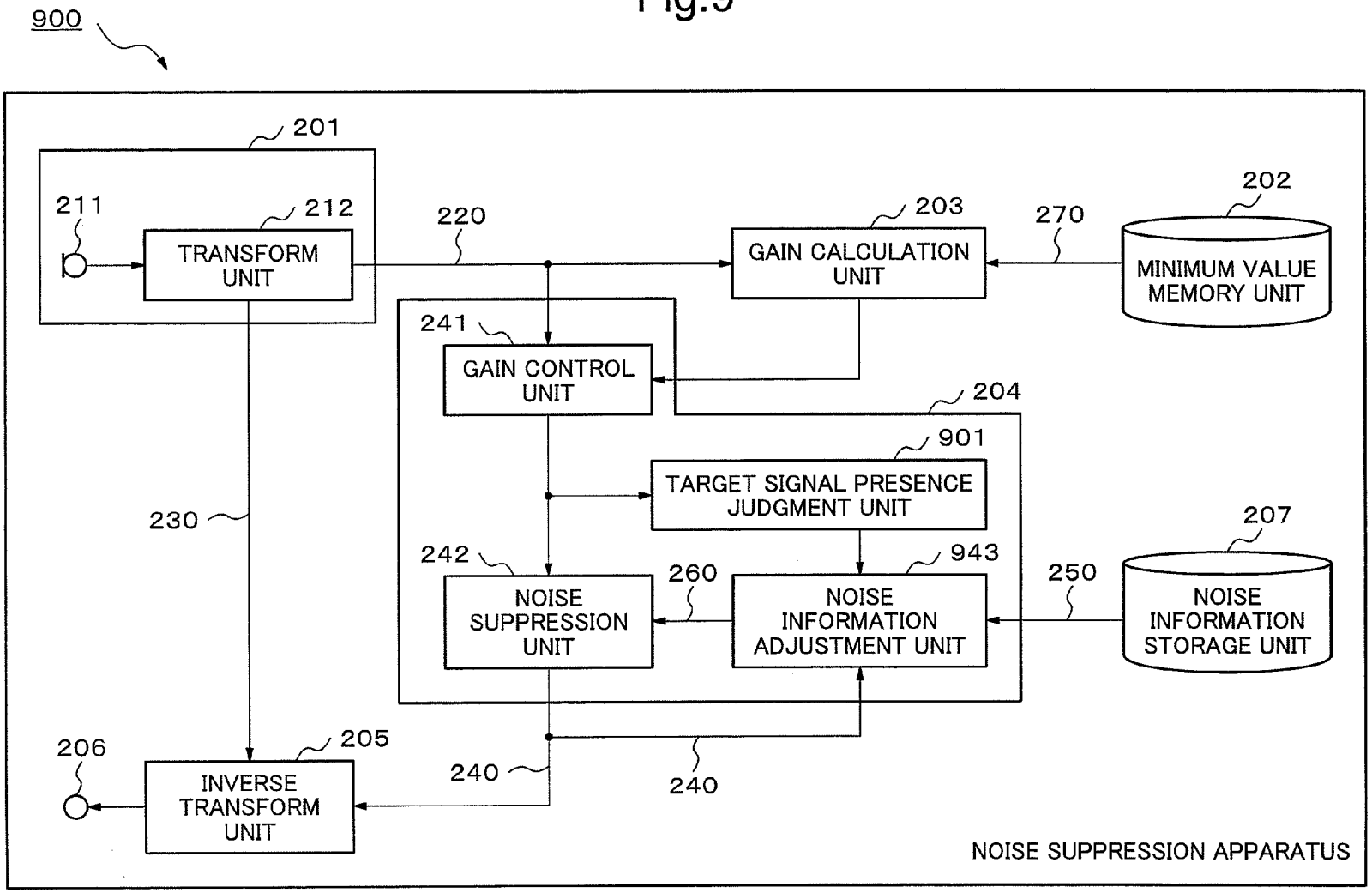
FIG. 9 It is a block diagram showing a schematic configuration of a noise suppression apparatus as a sixth exemplary embodiment of the present invention.

A sixth exemplary embodiment of the present invention will be described using FIG. 9. A noise suppression apparatus 900 in this exemplary embodiment includes a target signal existence judgment unit 901. A noisy signal amplitude spectrum to which the gain was applied in the gain control unit 241 is transmitted to the target signal existence judgment unit 901. The target signal existence judgment unit 901 determines whether a target signal exists in the noisy signal amplitude spectrum, or how many target signals exist.

A noise information adjustment unit 943 updates information for modification which adjusts noise information based on the judgment result by the target signal existence judgment unit 901. For example, because all noisy signals include noise when there are no target signals, the suppression result by the noise suppression unit should be zero. Accordingly, the noise information adjustment unit 943 adjusts the scaling factor 510 so that the noise suppression result at that time will be zero.

On the other hand, when a target signal is included in the noisy signal, the noise information adjustment unit 943 updates information for modification in the modification unit in accordance with the existence ratio of the target signal. For example, when the target signal exists 10% in the noisy signal, the noise information adjustment unit 943 updates information for modification partially (only 90%).

Because the noise suppression apparatus 900 according to this exemplary embodiment updates the modified information in accordance with the ratio of noise in the noisy signal in addition to the effect of the second exemplary embodiment, it can obtain a more highly-accurate noise suppression result.

(Other Exemplary Embodiment)

Although the noise suppression apparatus with the respectively different feature was described in the first to the sixth exemplary embodiments mentioned above, a noise suppression apparatus of any combination of those features is also included in the category of the present invention.

The present invention may be applied to a system including a plurality of apparatuses and it may be applied to a lone apparatus. Moreover, the present invention can be applied also when the signal processing program of the software which realizes the function of the exemplary embodiment is supplied directly or from remoteness to a system or an apparatus. Accordingly, in order to realize the function of the present invention by a computer, a medium which stored a program installed in a computer or the program and a WWW (World Wide Web) server which it makes the program download are also included in the category of the present invention.

Figure 10:
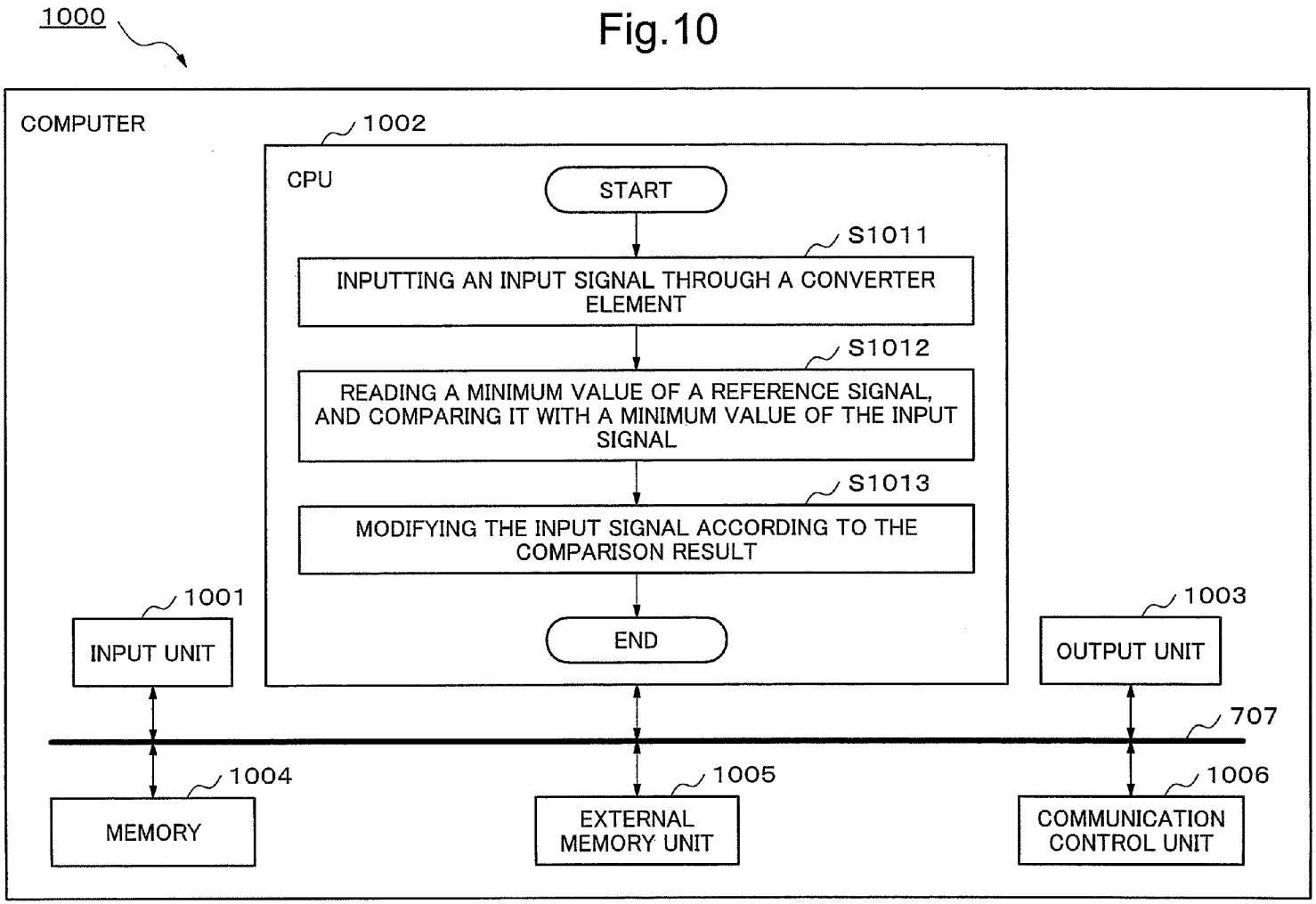
FIG. 10 It is a schematic configuration diagram of a computer which executes a signal processing program as other exemplary embodiment of the present invention.

FIG. 10 is a block diagram of a computer 1000 which executes a signal processing program when the above-mentioned exemplary embodiment is formed by the signal processing program. The computer 1000 includes an input unit 1001, a CPU (Central Processing Unit) 1002, an output unit 1003, a memory 1004, an external memory unit 1005 and a communication control unit 1006.

The CPU 1002 controls operations of the computer 1000 by reading the signal processing program. That is, the CPU 1002 that has executed the signal processing program inputs an input signal of a noisy signal through a converter device of a mike (S 1011). Next, the CPU 1002 compares a minimum value of an inputted reference signal and a minimum value of the input signal through a reference converter device (S 1012). And CPU 1002 modifies the input signal in accordance with the comparison result (S1013).

As a result, the same effect as the above-mentioned exemplary embodiment can be obtained.

In the above, although the present invention has been described with reference to the exemplary embodiments, the present invention is not limited to the above mentioned exemplary embodiments. Various changes which a person skilled in the art can understand in the scope of the present invention can be performed in the configuration and the details of the present invention.

This application insists on priority based on Japanese Patent Application No. 2010-263021 proposed on Nov. 25, 2010 and takes everything of the disclosure here.

The invention claimed is:

1. A signal processing device comprising:

an input unit which inputs an input audio signal including noisy speech through a converter device;

a memory unit which stores a minimum value of a reference signal recorded in a quiet room through a reference converter device;

a comparison unit which compares a minimum value of the input audio signal and the minimum value of the reference signal to generate a comparison result; and a modification unit which modifies the input audio signal in accordance with the comparison result of the comparison unit for compensating a difference between the converter device and the reference converter device.

2. The signal processing device according to claim 1, wherein the comparison unit calculates a ratio of the minimum value of the input audio signal to the minimum value of the reference signal, and the modification unit performs gain control over the input audio signal in accordance with the ratio calculated in the comparison unit.

3. The signal processing device according to claim 1, wherein the modification unit determines a modification factor so that the minimum value of the input audio signal and the minimum value of the reference signal become identical, and modifies an output of the converter device using the modification factor.

4. The signal processing device according to claim 1 wherein the modification unit comprises a noise suppression unit which suppresses noise in a noisy signal using noise information and a noise information adjustment device which adjusts the noise information and supplies an adjusted noise information to the noise suppression unit in accordance with the comparison result.

5. The signal processing device according to claim 4, wherein the noise information adjustment device further adjusts the noise information based on a suppression result of noise in the noisy signal.

6. The signal processing device according to claim 4, wherein the modification unit further comprises noise information memory unit which stores the noise information to be supplied to the noise information adjustment unit.

7. The signal processing device according to claim 4, wherein the modification unit inputs the noise information from a noise source and uses the noise information for noise suppression.

8. The signal processing device according to claim 4, wherein the modification unit inputs information on whether noise exists in the input audio signal and modifies the input audio signal when noise exists in the input audio signal.

9. The signal processing device according to claim 4, wherein the modification unit determines how much target signal exists in the input audio signal as an estimated target signal and adjusts the noise information based on the estimated target signal.

10. The signal processing device according to claim 1, wherein the converter device is a microphone.

11. A signal processing method comprising:

a step of inputting an input audio signal including noisy speech through a converter device;

a step of comparing a minimum value of a reference signal recorded in a quiet room through a reference converter device and stored in a memory, with a minimum value of an input audio signal to generate a comparison result; and a step of modifying the input audio signal in accordance with the comparison result for compensating a difference between the converter device and the reference converter device.

12. A non-transitory computer readable recording medium which stored a signal processing program which makes a computer execute:

a step of inputting an input audio signal including noisy speech through a converter device;

a step of comparing a minimum value of a reference signal recorded in a quiet room through a reference converter device and a minimum value of an input audio signal to generate a comparison result; and a step of modifying the input audio signal in accordance with the comparison result for compensating a difference between the converter device and the reference converter device.

13. A signal processing device comprising:

input means for inputting an input audio signal including noisy speech through a converter device;

memory means for storing a minimum value of a reference signal recorded in a quiet room through a reference converter device;

comparison means for comparing a minimum value of the input audio signal and the minimum value of the reference signal to generate a comparison result; and modification means for modifying the input audio signal in accordance with the comparison result of the comparison means for compensating a difference between the converter device and the reference converter device.

* * * * *